US008381787B2

(12) United States Patent
Elsperger

(10) Patent No.: US 8,381,787 B2
(45) Date of Patent: Feb. 26, 2013

(54) SPLICING DEVICE AND METHOD FOR SPLICING A SHEET-LIKE FLAT MATERIAL

(75) Inventor: Stefan Elsperger, Soechtenau (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 13/116,891

(22) Filed: May 26, 2011

(65) Prior Publication Data

US 2011/0290407 A1 Dec. 1, 2011

(30) Foreign Application Priority Data

May 27, 2010 (DE) ..... 10 2010 021 732

(51) Int. Cl.
*B65H 19/18* (2006.01)

(52) U.S. Cl. ..... 156/502; 156/157; 156/159; 156/504; 242/551; 242/555.3; 242/555.6; 242/556

(58) Field of Classification Search ..... 156/157, 156/159, 502, 504
See application file for complete search history.

(56) References Cited

U.S. PATENT DOCUMENTS

| | | | | |
|---|---|---|---|---|
| 4,708,300 | A * | 11/1987 | Goetz | 242/551 |
| 5,209,247 | A * | 5/1993 | Rittershaus et al. | 131/58 |
| 5,863,381 | A * | 1/1999 | Magota et al. | 156/507 |
| 6,360,871 | B1 * | 3/2002 | Meyer et al. | 198/419.1 |
| 6,500,288 | B2 * | 12/2002 | Hara et al. | 156/159 |
| 6,923,880 | B2 * | 8/2005 | Keene et al. | 156/159 |
| 7,147,737 | B2 | 12/2006 | Rassl et al. | |
| 7,263,812 | B2 | 9/2007 | Von Triel et al. | 53/167 |
| 2007/0044896 | A1 | 3/2007 | Tingley | 156/157 |
| 2008/0148691 | A1 * | 6/2008 | Elsperger | 53/442 |
| 2010/0024364 | A1 | 2/2010 | Schagidow | 53/463 |

FOREIGN PATENT DOCUMENTS

| | | | |
|---|---|---|---|
| DE | 25 37 882 | A1 | 3/1977 |
| DE | 37 27 339 | | 3/1989 |
| DE | 103 01 347 | A1 | 2/2004 |
| DE | 10 2004 032 528 | B3 | 8/2005 |
| DE | 10 2006 037 189 | A1 | 2/2008 |
| EP | 0 749 924 | A1 | 12/1996 |
| EP | 1 600 412 | A1 | 11/2005 |
| FR | 76 258 44 | | 3/1977 |
| WO | WO 2009/148910 | A2 | 12/2009 |

* cited by examiner

*Primary Examiner* — Mark A Osele
*Assistant Examiner* — Nickolas Harm
(74) *Attorney, Agent, or Firm* — Davidson, Davidson & Kappel, LLC

(57) ABSTRACT

A splicing device (13) and a method for the transport and feeding of plastic film (8) to a processing station. In this processing station the articles are wrapped in the plastic film (8) and the film (8) can subsequently be shrunk. This device includes a supply of film rolls with at least three separate film rolls (1 to 6) that are subsequently fed to a conveyor. The device furthermore includes a fixation device (20, 24, 26) arranged between the conveyor and the film rolls (1 to 6). The fixation device (20, 24, 26) fixes and joins the beginnings of film of new full film rolls (2 to 6) to the sheet of film currently fed into the processing device.

6 Claims, 9 Drawing Sheets

SPLICING DEVICE AND METHOD FOR SPLICING A SHEET-LIKE FLAT MATERIAL

This claims the benefit of German Patent Application DE 10 2010 021 732.8, filed May 27, 2010 and hereby incorporated by reference herein.

The present invention relates to a splicing device with at least three roll-off devices for one roll of sheet-like flat material each. The invention furthermore relates to a method for splicing a sheet-like flat material.

BACKGROUND

Such devices and methods are used in packaging machines for packaging groups of articles, packs out of several articles and/or pallets. The groups, packs and/or pallets are wrapped in plastic film or another suitable flat sheet-like material. The film sections wrapped around the groups of articles or packs are welded and/or shrunk under heat. The flat material or sheets of film are generally provided as a continuous material and unrolled from big supply rolls. If the material on the rolls is used up or depleted, the rolls must be replaced. When exchanging the rolls the machine should not be stopped. Therefore in known machines the switching between two material rolls is usually done partially or fully automated. Known packaging modules used in the field of one way packaging usually use automatic modules for the welding of the sheets of film. During the exchange of the material rolls these modules connect the end of a sheet of film of an almost depleted unrolled roll of film with a new full film roll. Even when changing to a different type of film old and new film webs are equally welded together.

Since the rolls are often arranged in a lower machine level, mostly unfavorable ergonomic conditions exist for the handling of film rolls. Setting up and fixing the new beginnings of the sheet of film as well as finding and eliminating errors requires a relatively large manual effort from the person operating the machine. The installation space normally available limits the storage volume for the roll of films. As a result of the existing principle of automatic sheet welding only one film roll can usually be stored in reserve. Due to the limited space the roll diameter is limited to a certain maximum. Depending on machine power and depending on the articles to be packed, a relatively frequent roll change has to be carried out by the person operating the machine.

DE 10 2004 032 528 B3 describes a method for performing a roll exchange in a supply unit. Hereby a sheet-like flat material used in a packaging machine is unwound from a roll. A roll exchange is required as soon as the roll is depleted. Hereby the end of the material sheet from the first roll is connected to the beginning of the material sheet of a new full roll by a connecting station. The connecting portion of the material sheet of the new roll is mounted in a holding- and positioning unit for exact positioning. The holding- and positioning unit is associated with the connecting station but located apart from the supply of new full rolls.

DE 10 2006 037 189 A1 discloses a method that is an improvement of the older method described above. Hereby each connecting portion of the material sheet of the new roll is fixed to a positioning element of the connecting station for exact positioning. A corresponding holding and positioning element is formed by a pinch roller that comprises a manually rotatable axis.

EP 0 749 924 A1 discloses a method and apparatus for welding of two sheets of film in a packaging machine, whereby each sheet of film comes from a supply roll. The beginning of the sheet of film belonging to the initially stationary full second supply roll, is deflected and held against the direction of movement of the sheet of film coming from the emptying first supply roll. The status of unrolling the running sheet of film is electronically monitored and a stop signal for the film feeding mechanism is produced, leading to a subsequent compression and welding of the two sheets of film over their entire width. The two sheets of film are arranged anti-parallel to each other. Simultaneously excess end pieces of the sheets of film are separated and a further signal is generated to restart the film feeding mechanism.

From EP 1 600 412 A1 a film splicing station is known that comprises a first and a second roll-off device for one roll of film each. The station comprises a splicing device for splicing the films from the first and second roll-off device at a splicing position, a movable transfer device for transferring a film from a roll-off device to the splicing station and a holding device for stationary holding the film, which can be transferred through the transfer device.

SUMMARY OF THE INVENTION

The known methods and devices used for exchanging the rolls do not eliminate the basic disadvantages of the relatively limited storage volume for flat material sheets or film webs. As a result of the existing principle of automatic connection of the material sheets only one supply roll can be held in reserve. Therefore with longer run times of the machines a manual change of the already depleted roll and an exchange for a new supply roll might be necessary. Thus the need arises for frequent roll exchange by operating personnel.

It is an object of the present invention to provide an improved handling of sheet-like flat material, in particular an improved handling of films used for packaging articles and packs of articles and to provide a larger supply of sheet-like flat material provided on multiple supply rolls, whereby the sheet-like flat material is unrolled from the supply rolls and fed to the packaging machine without frequent manual intervention or frequent roll changes, which are usually required during the running of the machine. In particular, a device and a method for handling of film should be made available, each allowing a simple and largely automated exchange between several supply rolls of film.

The present invention provides a splicing device with at least three roll-off devices for one roll of sheet-like flat material each. The splicing device comprises at least three welding bars, which are arranged and can be moved within an approximately common plane, which is preferably a nearly horizontal plane. In addition, at least one clamping means is provided which is positioned in an approximately horizontal plane above the welding bars and can be moved within this approximately horizontal plane. According to the present invention one of the welding bars is assigned to each of the at least three roll-off devices. The invention thus provides a device for splicing of sheet-like flat material, which especially forms a film splicing device for three or more rolled-up supply units of sheet-like flat material or film. These three or more supply rolls merge in a common plane, which contains the splicing device with three or more movable welding bars. The welding bars can, for example, be moved in the common plane by means of a controllable hydraulic cylinder or other suitable displacement means or displacers in order to allow a separation of the depleted roll and a simultaneous welding of the new roll during exchange of the rolls. A controllable and adjustable clamping means or clamp is arranged above the welding bars. The clamping means can be moved within an approximately horizontal plane above the welding bars and can thus be assigned to the active welding bar and the corresponding roll-off device. The clamping means is positioned accordingly. At the same time the clamping means forms a deflection device exactly guiding the unrolling of the sheet-like flat material from the previously spliced roll currently in use.

The splicing device according to the invention can be an important component of a device for transporting and supplying of sheet-like flat material or sheet like plastic film supplied on rolls to a processing station for packaging of articles and/or uniting of articles in packs. This can for example be done by wrapping the articles with plastic film, which can optionally be followed by shrinking of the film. In this device the supply of film rolls comprises at least three separate film rolls, which are successively fed to a conveyor. Between the conveyor and the film rolls a fixing device for fixing the beginnings of the sheets of film of the still full film rolls is provided. This fixing device is also used for controllably fixing one of the film ends—called the beginning of the sheet of film—of a full film roll to the sheet of film leading to or fed into the processing station. Even if the words foil or plastic film are mostly used in the present context when describing the invention, this material definition is not to be understood as limiting. Plastic film is generally suitable as packaging material, especially as the most commonly used plastic films shrink in a desired manner when heated, thereby achieving a good fixation of goods, articles and packs to be packaged. This material assignment by no means excludes the possibility that other materials can be processed and handled with the device and the method according to the invention. For example, paper-like flat material sheets or film-like flat material sheets of organic or inorganic material that is subsequently shrunk either by heat treatment or e.g. by chemical treatment can be used accordingly. At this point it is therefore explicitly emphasized that the terms film, sheet of film or plastic film cover a wider scope than just the material defined in physical terms.

The device according to the invention can handle and process a wide variety of sheet-like flat materials by means of the fixing device which—according to the invention—is formed by welding bars. The materials are connected at the ends or beginnings of the material sheet by e.g. sticking or cramping, but in particular welding. When using sheet-like film material, e.g. the often used shrinkable plastic film, a welding device is preferably used to fix the beginnings of the film material. The welding device welds the film beginnings of the still full film rolls or supply rolls to the sheet of film currently fed into the device leading towards the processing station. According to the present invention the welding device is formed by welding bars. At the same time as the film materials are welded together, the connection to the almost depleted roll of film is severed or separated. After the exchange of the rolls the sheet of film fed into the processing station is now connected to the new film supplied from the new roll.

It can also be provided that the welding bars of the splicing device according to the invention are designed for fixing the beginning of the still full new roll of sheet-like flat material and for controllable welding the beginning of a still full new roll of sheet-like flat material to the sheet-like flat material of the largely depleted roll currently fed into the processing station. Thereby the sheet-like flat material of the largely depleted roll is simultaneous separation from the largely depleted roll. The welding bars may especially comprise several clamping means that can be pressed against each other. The clamping means are used for the temporary and simultaneous fixation of all beginnings of sheet-like flat material of yet unrolled supply rolls and for the fixation of the end of the sheet-like flat material from the roll currently fed into the processing station.

The invention can furthermore comprise a clamping means associated with the fixing or welding device. The clamping means temporarily fixes the sheet of film fed into the processing station. The position of the clamping means can be assigned to one of the film supply rolls, especially to the film roll that is to be activated next. The clamping means may for example be a deflection roller that can be positioned variably and can comprise a movable clamping bar or the like. In this way the clamping means can improve the exact guidance of the film or the sheet-like flat material. On the one hand the clamping means is always positioned close to the currently used activated film roll. On the other hand the clamping means ensures that during the exchange of the rolls and during the welding process the end of the sheet of film still in the processing station does not slip away and is unintentionally cut during the welding process. This would require a stopping of the packaging machine to manually reconnect the ends of the sheet of films before the required transport of the sheet of films can be resumed.

In a particularly effective embodiment of the device according to the invention the welding device comprises a plurality of clamping means that can be pressed against each other. The clamping means are used for the temporary, simultaneous fixation of all film beginnings of the full, not yet unrolled film rolls. The clamping means are furthermore used for the temporary, simultaneous fixation of the end of the respective active film roll, which material is currently fed into the processing station and that is to be welded to the beginning of the supply film roll that is to be activated next. The clamping means can be formed by several so called welding bars that can be moved within a common plane. The welding bars can be pressed against each other, simultaneously fixing all film beginnings during roll exchange. This allows welding at the desired position. Preferably each film roll is associated with and fixed to one movable welding bar. The film is fixed for example by vacuum and/or by means of electrostatic charge. In this way the film beginnings of the supply film rolls are kept in readiness to be used. The sheet from the active film roll, which is used and unwound during the ongoing operation of the processing station or packaging line, simultaneously runs through the open clamping bars. If the active film roll is almost depleted and therefore needs to be exchanged, the welding bars are pressed against each other thereby fixing and holding all beginnings of film material. The welding bars can be pressed together by the use of suitable pressing cylinders or the like. The welding devices that are mostly called welding bars in the present context can for example comprise a suitable sliding guidance with suitable return means allowing an easy going horizontal movement. On the one hand the welding bars can be easily pressed together. On the other hand the welding bars automatically separate from each other when the pressing cylinders are not activated, thereby not impairing with the freedom of motion of the moving sheet of film.

The film beginning of the next supply roll, entwining the respective welding bar at least partially, is pressed against the still connected sheet of film of the almost unrolled, depleted film roll. At the same time the clamping means, which can be positioned above the welding devices, is activated by locking the clamping bar against the deflection roller. Thereby disengagement and loss of the film section running through the processing machine can be prevented reliably. The connection can be changed by activating the appropriate welding device and simultaneously activating a separation device. The remnant of the film from the almost depleted film roll fed into the machine is severed or separated. At the same time a welding process takes place, connecting the new film roll to the sheet of film currently positioned in and running through the processing machine.

The device according to the invention allows different dimensions for the supply of film rolls. The supply can comprise three, four, five, six or optionally even more film rolls.

Apart from the previously described different embodiments of the splicing device and of the device for the variable supply of sheet-like flat material to a processing machine, the present invention also relates to a method for splicing sheet-like flat material. The method especially relates to the splicing of sheet-like flat material from a first roll-off device to another sheet-like flat material from a second, third or further roll-off device. During this process the sheet-like flat material is fixed and connected or joined by welding. The sheet-like flat material is fixed by several welding bars. The welding bars are arranged in a common plane and can be moved towards each other within this common plane. The sheet-like flat material is held and guided by a clamping means that is positioned almost right above the currently activated welding bar and that can be moved in an almost horizontal plane above the welding bars. The connection between the two films is made by activation of the respective welding bar. In this way the beginning of a sheet of film of a still full, new film roll is connected to the sheet of film of the previously unrolled, almost depleted film material.

According to a preferred embodiment of the method the sheet of material currently fed into the processing station can be welded to a new sheet of film material of a new full supply roll when the material of the currently used roll is almost depleted. At the same time the sheet of film material from the almost depleted roll is severed and/or separated. During the welding of the material sheets, a section of the sheet of material fed into the processing station can be held or fixed and guided to a position close to the welding site. During the welding process several or all of the welding bars are preferentially pressed against each other. Thereby all beginnings of yet unrolled sheets of film are clamped and fixed simultaneously. At the same time the respective sheet of the currently used material fed into the processing machine is clamped and fixed too.

According to one embodiment of the inventive method sheet-like flat material used for packaging articles and/or for combining or uniting articles into packs is fed to a processing station. The sheet-like flat material or plastic film is wrapped around the articles or groups of articles and can then subsequently be shrunk onto the articles or groups of articles. The sheet-like flat material or plastic film is taken from a supply of at least three separate film rolls, which are subsequently supplied to a conveyor. The sheet-like flat material or plastic film is transported by a fixing and connection device. The fixing and connection device is arranged between the conveyor and the film rolls and fixes the beginnings of the film of the full supply rolls. At the same time the beginning of at least one full film roll is connected to the sheet of film currently running towards and fed into the processing station. The phrase active film roll is used for a roll from which film is currently unrolled and fed into the processing station. When the active roll is almost depleted, the sheet of film of the active film roll is welded to the sheet of film of a new full film roll. Simultaneously the sheet of film of the almost depleted film roll is cut and/or separated. During welding of the sheets of film a section of the film, which is currently fed into the processing station and which is located close to the welding device, can be held or clamped and guided close to the welding site.

During welding of the sheets of film several clamping means are preferably pressed against each other. Thereby all beginnings of the yet unrolled film rolls and the respective end of the sheet of film from the almost depleted roll currently fed into the processing station are clamped and fixed simultaneously. The welding device can be formed in a way that it is able to fix the film beginnings of the supply rolls by welding bars. The welding bars can be moved within a common plane, whereby the welding bars can especially be pressed against each other. The ends of the film can be severed or separated by separation bars that can be activated separately. The ends of the film can thereby be held or fixed by fixing means working with low pressure and/or static charge.

It should be emphasized that all aspects of the invention described above in regards to the device for feeding and transportation of sheet-like flat material or plastic film also apply to the method for feeding and transportation of sheet-like flat material and vice versa. Because the device and method describe several aspects of a single inventive idea, all the embodiments described have to be seen in the same context and should not be separated.

Preferably the status of a film roll is monitored automatically. Especially it can be automatically recognized when a roll is almost depleted and therefore the automatic exchange and welding of film is initiated. The automatic monitoring in addition to the use of several supply rolls leads to prolonged uninterrupted machine cycle times of several hours. During these prolonged running times no manual interventions are required. Especially it is not necessary to manually supply new rolls of packaging film. With the known methods it was only possible to switch between two film rolls that were used alternatively. With the device and method according to the present invention three, four or more rolls can be used subsequently without the need of manual exchange. This leads to very long running times of the packaging machines during which no manual intervention is required.

The supply of film rolls can be arranged laterally next to the packaging machine. Therefore the diameter of the used film rolls is not restricted anymore. Rolls with a bigger diameter carrying longer sheets of film can therefore be handled and processed. When using six film rolls with a diameter of 600 mm each it is therefore possible to run a packaging machine producing disposable packages a whole shift long without the need of a manual intervention by an operator.

BRIEF DESCRIPTION OF THE DRAWINGS

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

Figure 1:
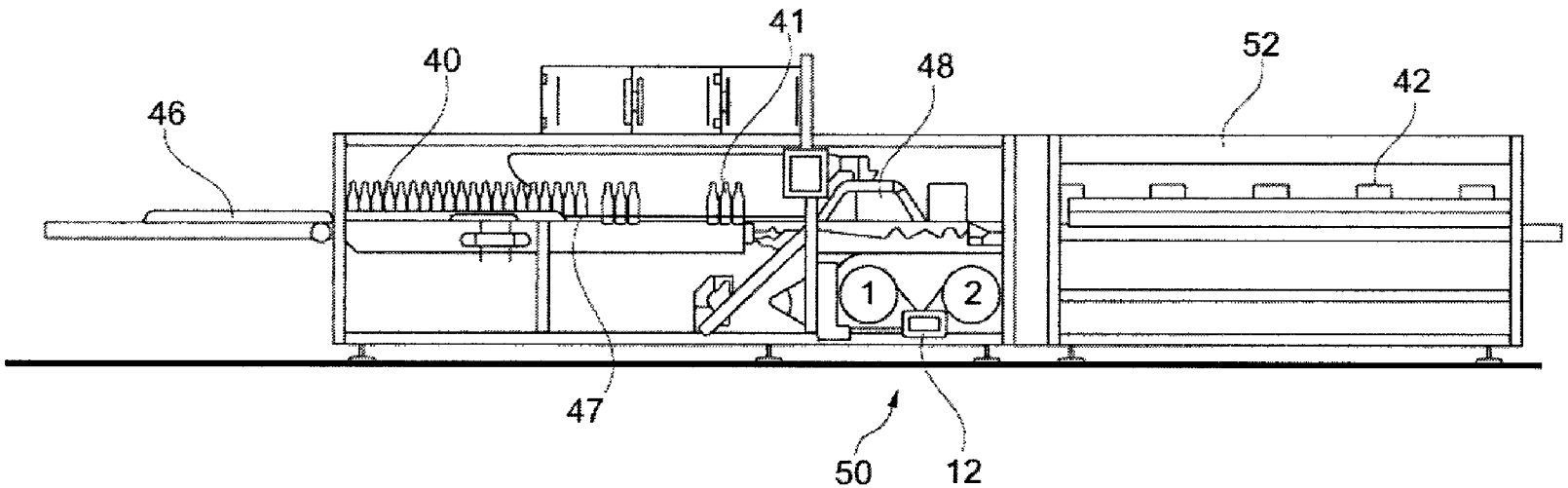
Fig. 1 (Prior art)
FIG. 1 schematically shows a module for the connection of two sheets of film known from prior art.

The same or equivalent elements of the invention are designated by identical reference characters. Furthermore and for the sake of clarity, only the reference characters relevant for describing the respective figure are provided. It should be understood that the detailed description and specific examples of the device and method according to the invention, while indicating preferred embodiments, are intended for purposes of illustration only and are not intended to limit the scope of the invention.

FIG. 1 schematically shows a module 12 for welding two sheets of film according to the known prior art. The module 12 is arranged below a film wrapping module 48.

Liquid containers, e.g. bottles 40 are transported via a container feeding mechanism 46 in a horizontal direction. The container feeding mechanism 46 can especially be an endless conveyor. The containers 40 are then grouped into packs 41 by a container divider 47 and subsequently wrapped with shrinking foil in a film wrapping module 48. The wrapped packs 41 are then transported into a shrinking tunnel 52 where heat is applied and the film is shrunk around the grouped containers 40 to produce the final packs 42. A supply of two film rolls, especially roll 1 and roll 2, as well as an attachment- and cutting device 50 are arranged below the film wrapping module 48.

During the exchange of the rolls, the sheet of film of the almost depleted roll 1 is connected to the sheet of film of the new full supply roll 2 by the attachment- and cutting device 50. The attachment- and cutting device 50 can especially be a welding device. When a new type of film is required, the old and the new sheets of film 1 and 2 are equally welded together. This welding process is also known as splicing. Therefore the attachment- and cutting device 50 or the welding device is also called splicing device or splicing module.

A major disadvantage of the known system is the unfavorable ergonomic situation regarding the exchange of the rolls 1 and 2. When the beginning of the new sheet of film needs to be fixed to the end of the old film or when errors need to be eliminated, a certain manual intervention by an operator is always necessary. As a result of the existing principle of automatic connection of the sheets of film only one supply roll—especially supply roll 2—can be held in reserve. Therefore the storage volume is limited to this second roll. Because of the limited space available only film rolls with a diameter of 500 mm maximum can be used. Depending on the product to be packed and depending on the capacity of the packaging machine, the film rolls need to be exchanged frequently by operating personnel.

Figure 2:
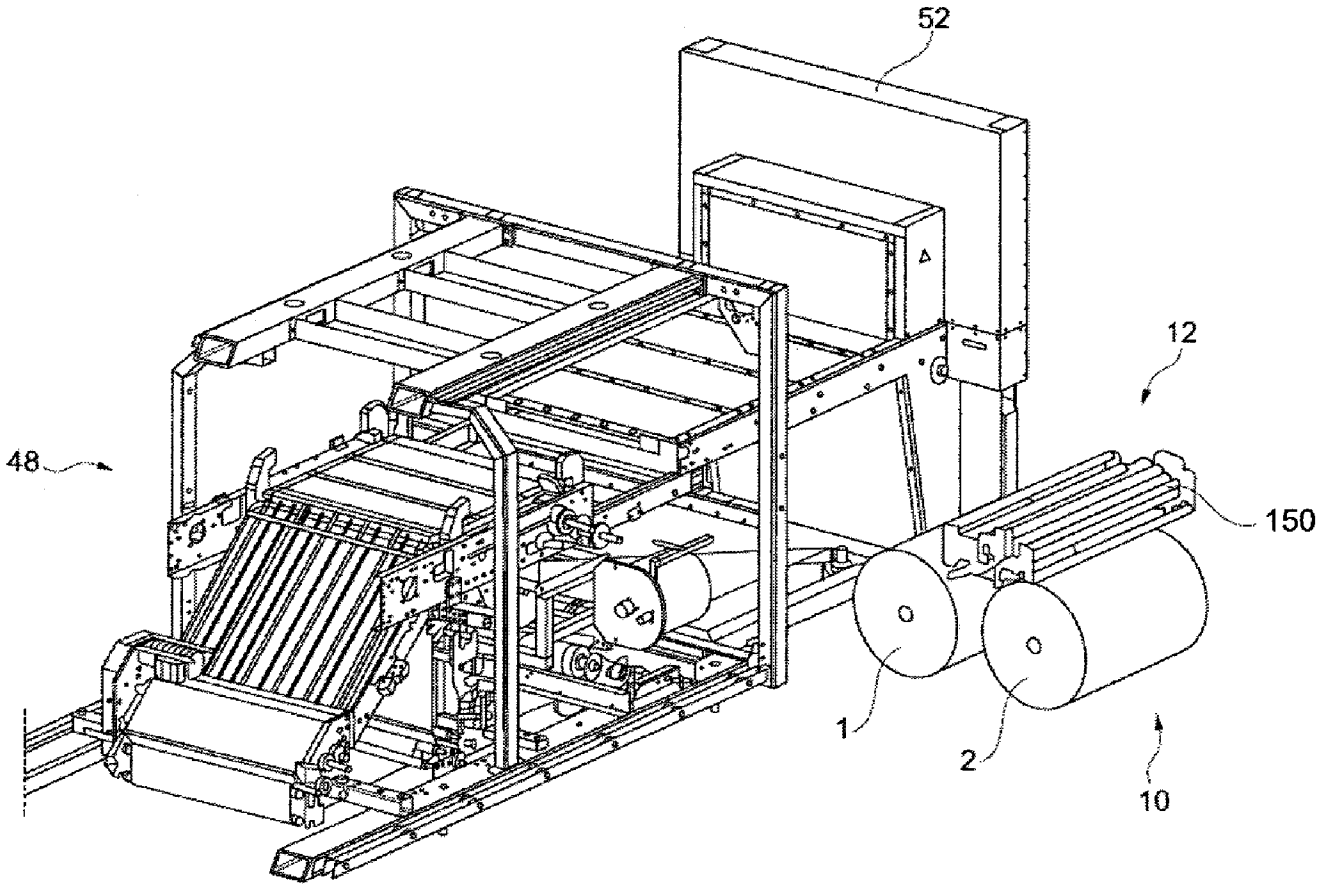
FIG. 2 shows an externally arranged film feeding device and film welding device.

The schematic representation of FIG. 2 shows an externally arranged film feeding device 10 and film welding device 12. Because these modules are arranged externally, especially beside the film wrapping module 48, the disadvantages regarding the bad ergonomic situation described above can be eliminated at least partially. In this embodiment a currently used film roll 1 and one supply roll 2 is shown. The welding station 150 of the present invention for film welding 12 is arranged above the film rolls 1 and 2. This further facilitates the handling.

Figure 3:
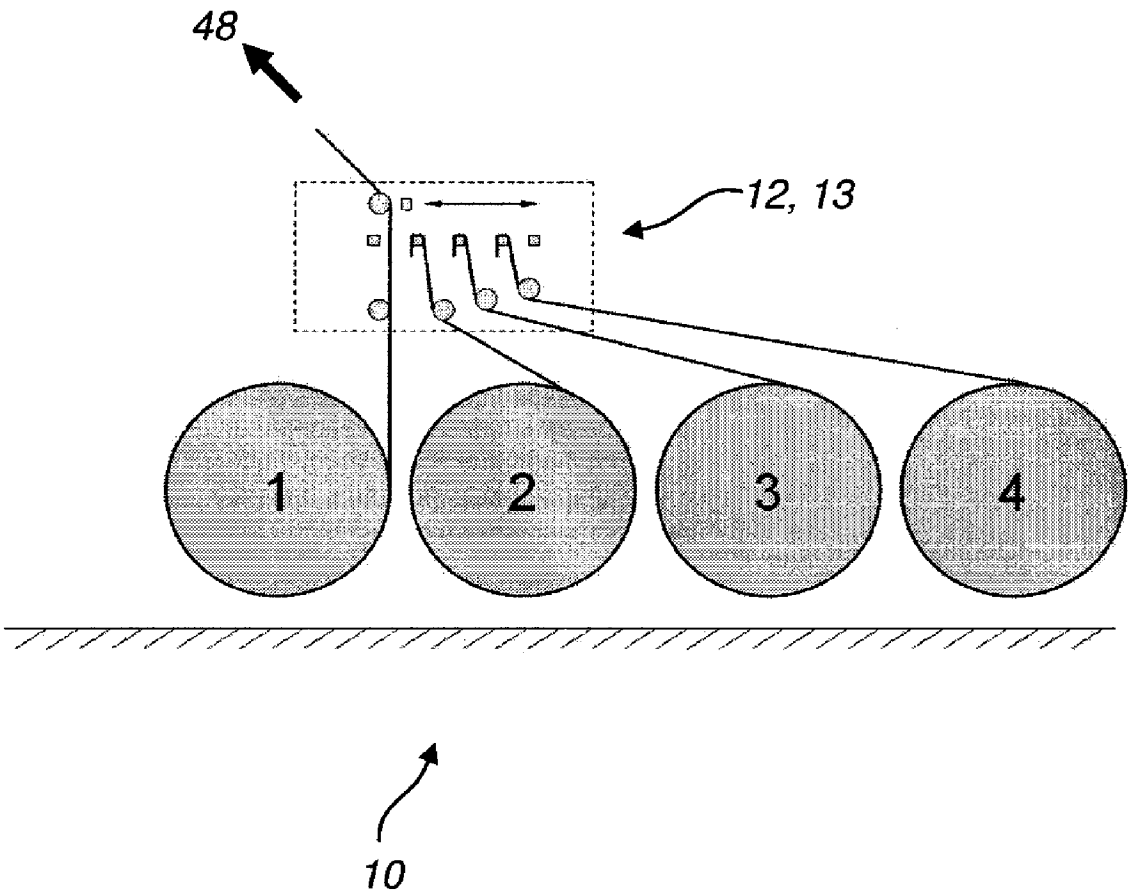
FIG. 3 and FIG. 4 respectively show a schematic representation of the inventive feeding device with automatic film welding located beside the packaging machine.
Figure 4:
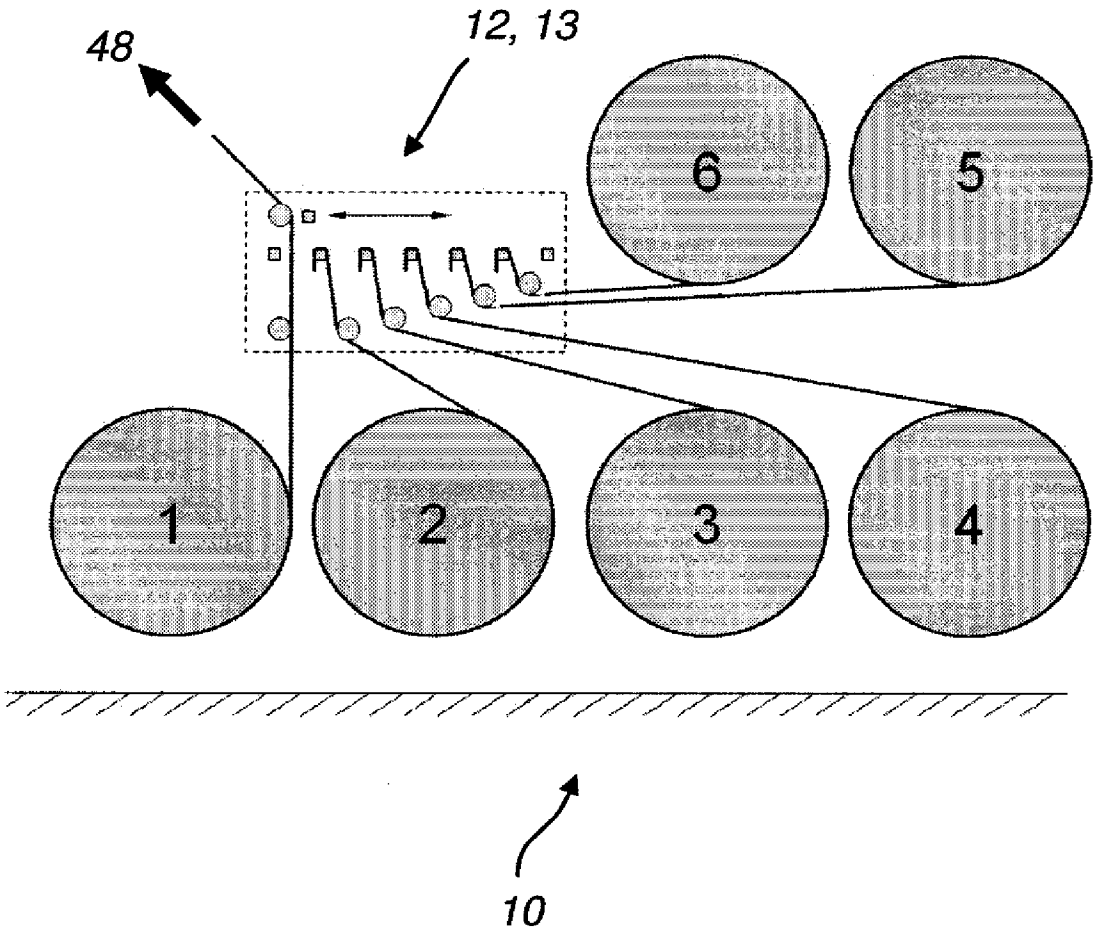

FIG. 3 and FIG. 4 respectively show a schematic representation of the inventive feeding device 10 with automatic film welding 12 located beside the film wrapping module 48 (see FIG. 2). The device 10, 12 comprises several splicing devices 13 according to the present invention. A variable number of supply rolls are used. The device especially comprises carriers for three, four, five or more supply rolls 2, 3, 4, 5 and 6. The first roll 1 is the currently used roll, meanwhile the further rolls 2, 3, 4, 5 and 6 are supplied as reserve and can be activated one after the other as soon as the first roll 1 or the consecutively activated roll 2, 3, 4 or 5 is depleted.

FIG. 5 to FIG. 9 show the setup and functional sequence of the automatic film welding 12 according to an embodiment of the invention. The automatic film welding 12 comprises a currently used film roll 1 and three supply rolls 2, 3 and 4 and a film feeding device 10 according to FIG. 3.

The film welding 12—which is also called splicing device 13 in the present context—comprises a centered welding bar 20 for each supply roll 2, 3 and 4. The splicing device 13 furthermore comprises two lateral welding bars 24, whereby the first lateral welding bar 24*a* is associated with the roll 1 used first, and whereby the second lateral welding bar 24*b* is associated with the supply roll 4 to be used last. Both lateral welding bars 24*a*, 24*b* are each associated with a controlled pressure cylinder 26, which is acting as a horizontally adjustable linear drive.

The centered welding bars 20 and the second lateral welding bar 24*b* (shown on the right side in FIG. 5) each comprises a separation device 22 for separation or severing of the sheet of film 8. A heatable cutting wire can for example be used as separation device 22. The beginning 9-2, 9-3 and 9-4 of each sheet of film 8-2, 8-3 and 8-4 from the supply rolls 2, 3 and 4 is fixed to their respective centered welding bar 20 via vacuum, static charge or something alike.

Figure 5:
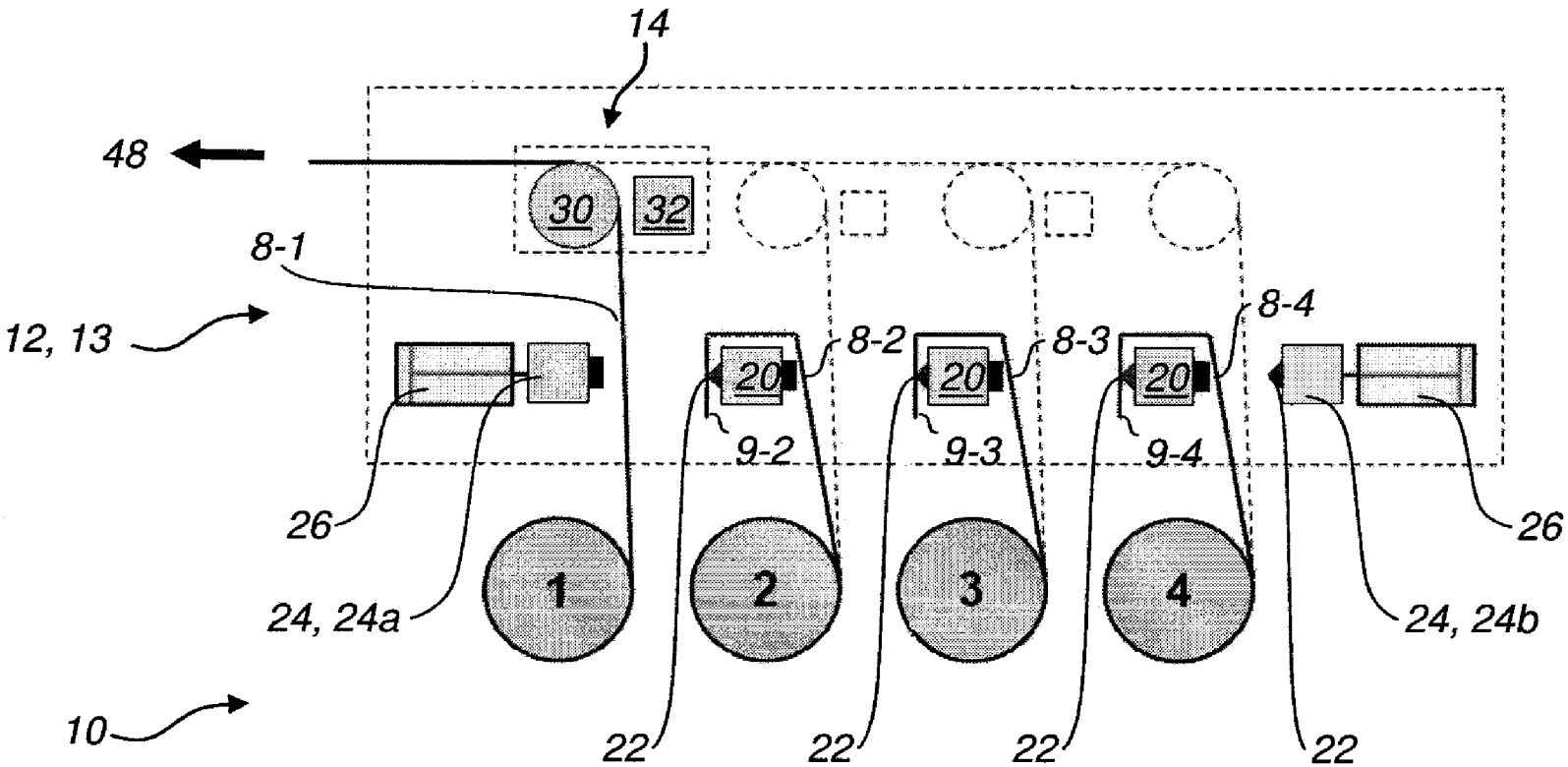
FIGS. 5, 6, 7, 8 and 9 show the setup and functional sequence of the automatic film welding according to an embodiment of the invention.

In FIG. 5 it is shown that the sheet of film 8-1 from the film roll 1 is transported to the film wrapping module 48 via a movable deflection roller 30. When the sheet of film 8-1 from film roll 1 is almost depleted, the remaining sheet of film 8-1 is actively clamped and thereby fixed temporarily. The film clamping means 14 comprises the movable deflection roller 30 and a clamping bar 32. Thereby the film clamping means 14 improves the guidance of the sheet of film 8-1 by positioning the sheet 8-1 close to the currently active film roll 1, 2, 3 or 4. The film clamping means 14 furthermore improves the guidance of the sheet of film 8-1 by securing the end of the sheet of film 8-1, 8-2, 8-3 or 8-4 currently fed into the processing machine against slippage, especially against slippage during the exchange of the rolls and the welding process. This ensures that the sheet of film 8-1, 8-2, 8-3 or 8-4 is not involuntarily cut during the welding. In that case it would be necessary to stop the machine to manually reconnect the ends of the sheet of films to guarantee the further uninterrupted transport of the sheet of films.

Figure 6:
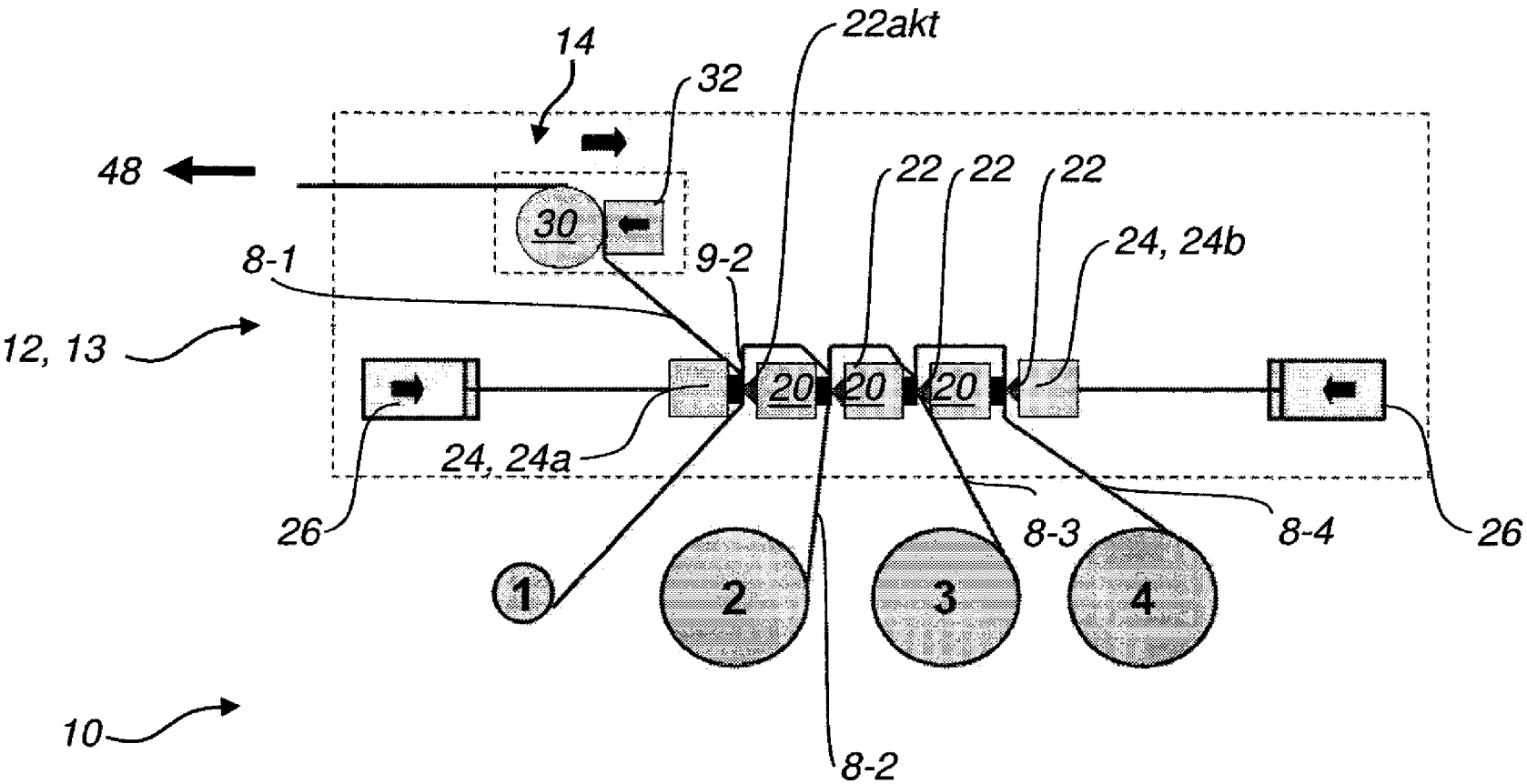
Figure 7:
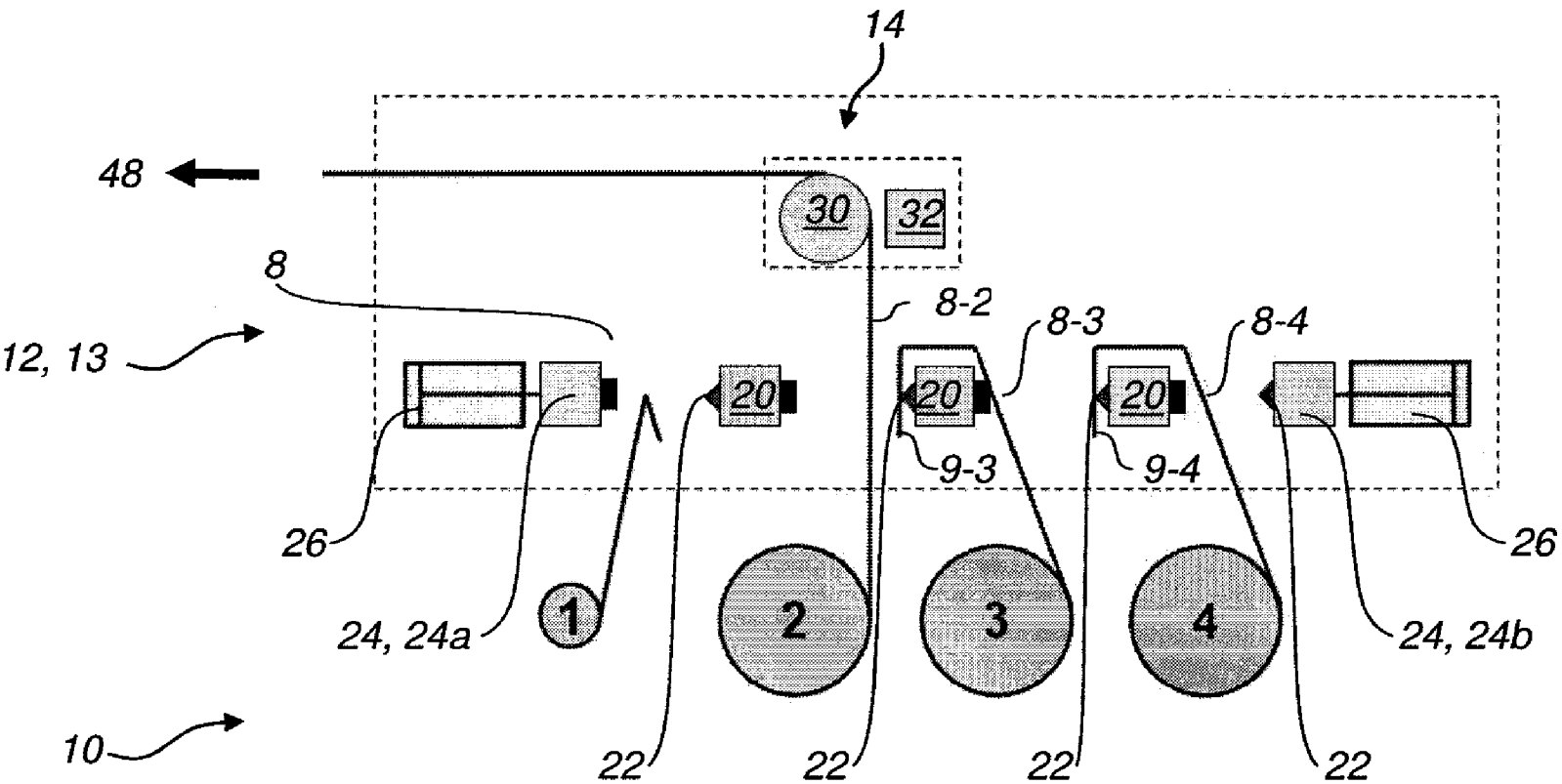

By pushing the pressing cylinders 26 against each other, the welding bars 20, 24*a*, 24*b* are pressed against each other. Especially the first lateral welding bar 24*a* is pressed against its neighboring centered welding bar 20 by the pressing cylinder 26. In that way the sheet of film 8-1 of the currently used first roll 1 and the beginning 9-2 of the film of the first supply roll 2 are in direct contact with each other. Now the separation wire 22*akt* (FIG. 6) is activated by heating, while the other wires 22 remain unactivated. The sheet of film 8-1 of the first roll 1 and the beginning 9-2 of the sheet of film 8-2 of the supply roll 2 are welded together (FIG. 6). Simultaneously the connection to the almost depleted roll 1 is cut. After the roll exchange the sheet of film 8-1 leading to the processing station is now connected to the sheet of film 8-2 of the new supply roll 2.

Figure 8:
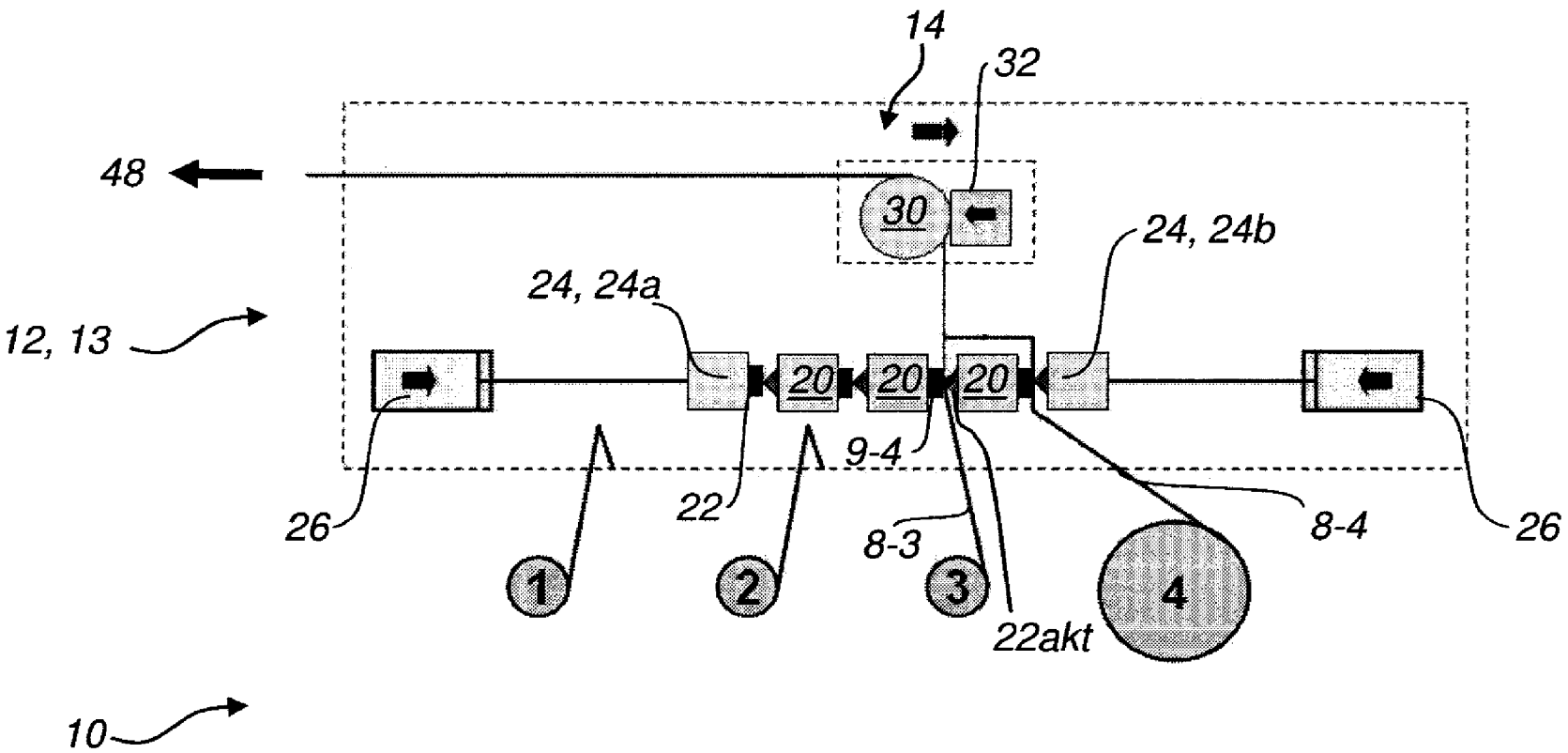
Figure 9:
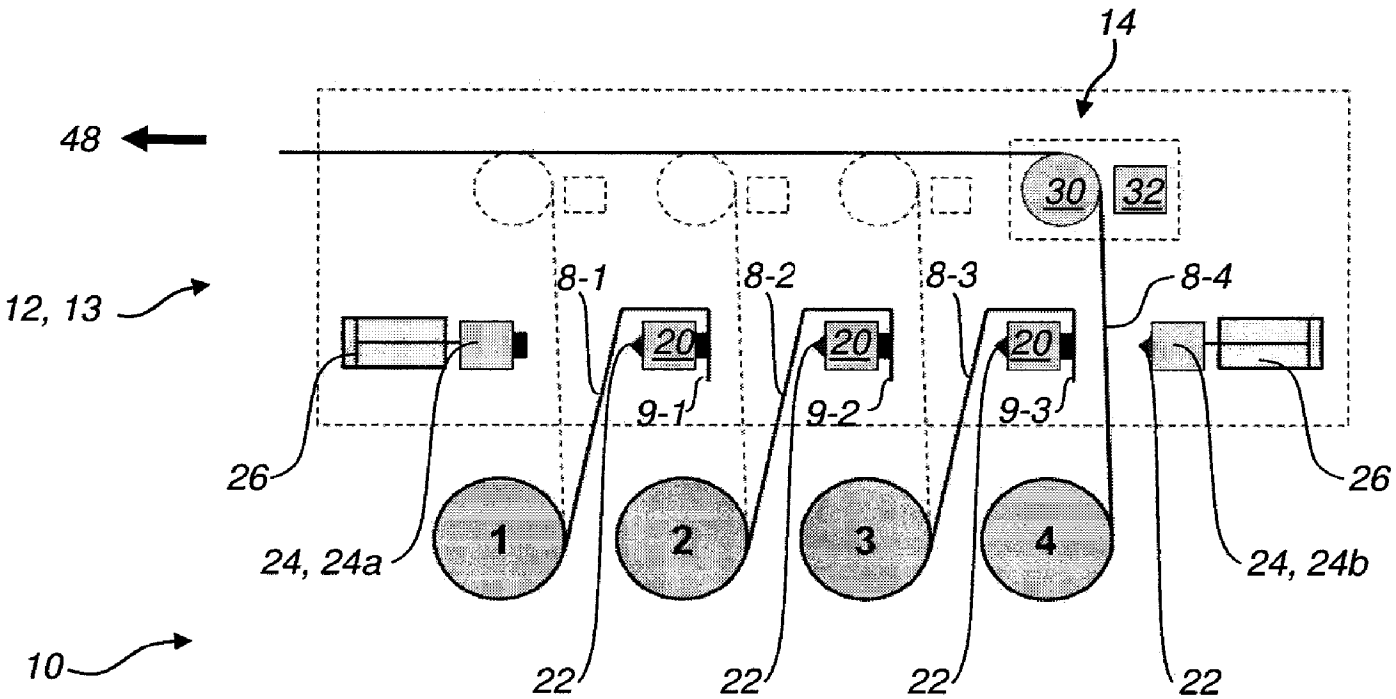

Now the deflection roller 30 and the clamping bar 32 are moved. Furthermore the welding bars 20, 24*a*, 24*b* are moved apart and the sheet of film 8-2 of supply roll 2 is fed into the film wrapping module 48 (FIG. 8). The movement of the welding bars 20, 24*a*, 24*b* can for example be done by resetting means of the pressing cylinders 26, whereby the movement of the transported sheet of films 8-1, 8-2, 8-3 and 8-4 is not impaired.

The same steps are applied when the sheet of film 8-2 of the supply roll 2 is almost depleted or when the sheet of film 8-3 of the supply roll 3 is almost depleted (FIG. 8). Preferentially each beginning 9-2, 9-3 or 9-4 of the sheet of film 8-2, 8-3 or 8-4 of the rolls 2, 3 or 4 entwines its respective welding bar 20 centered above the roll 2, 3 or 4. The beginning 9-2, 9-3 or 9-4 of the sheet of film 8-2, 8-3 or 8-4 of the roll 2, 3 or 4 that is to be activated next is pressed against the sheet of film 8-1, 8-2 or 8-3 of the almost depleted roll 1, 2 or 3. Simultaneously the clamping means 14 arranged above the welding device 12 is activated by locking or pressing the clamping bar 32 against the deflection roller 30. This secures the sheet of film 8-1, 8-2 or 8-3 currently fed into the processing device reliably, thereby preventing a loss of the film section 8-1, 8-2 or 8-3 currently running through the machine.

The connection can be changed by the activation of the respective welding means and the simultaneous activation of a separation means. Both functions can be combined in the separation wire 22*akt*, which allows both welding and cutting of the film. Meanwhile the remnants of the depleted roll 1, 2 or 3 are separated from the sheet of film 8-1, 8-2 or 8-3 fed into the processing device, the film of the new roll 2, 3 or 4 is connected to the sheet of film 8-1, 8-2 or 8-3 by welding.

While the last supply roll 4 is in use, the first three roll carriers are supplied with new full film rolls 1, 2 and 3. Thereby the beginnings 9-1, 9-2 and 9-3 of the new sheets of film 8-1, 8-2 and 8-3 are arranged in such a way, that after the sheet of film 8-4 of roll 4 is almost depleted, it can be connected to the beginning 9-3 of roll 3 and so on. This explains the different designs of the lateral welding bars 24*a*, 24*b*. It especially explains why the second lateral welding bar 24*b* comprises an activatable separation wire 22.

Preferentially the status of the film rolls 1, 2, 3 or 4 is monitored automatically. It is especially recognized when the roll 1, 2, 3 or 4 currently in use is almost depleted and therefore the automatic exchange and welding of sheet of films 8-1, 8-2, 8-3 or 8-4 has to be initiated. The automatic monitoring in addition to the use of several supply rolls 1, 2, 3 and 4 leads to prolonged uninterrupted machine cycle times of several hours. During these prolonged running times no manual interventions are required, because it is not necessary to manually supply new rolls 1, 2, 3 and 4 of packaging film. With the known methods it was only possible to switch between two rolls that were used alternatively. With the device and method according to the present invention three, four or more rolls 1, 2, 3 and 4 (and so on) can be used subsequently without the need of manual exchange. This leads to very long running times of the packaging machines during which no manual intervention is required.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE SYMBOLS

1 film roll 1
2 film roll 2
3 film roll 3
4 film roll 4
5 film roll 5
6 film roll 6
8 sheet of film
8-1 sheet of film of film roll 1
8-2 sheet of film of film roll 2
8-3 sheet of film of film roll 3
8-4 sheet of film of film roll 4
9 beginning of sheet of film
9-1 beginning of sheet of film 8-1
9-2 beginning of sheet of film 8-2
9-3 beginning of sheet of film 8-3
9-4 beginning of sheet of film 8-4
10 film feeding system
12 film sealing
13 splicing device
14 film clamping means/clamping means
20 central welding bar
22 cutting device/cutting wire
22*akt* activated cutting wire
24 lateral welding bar
26 pressure cylinder
30 movable deflection roller
32 clamping bar
40 container/bottle
41 packaging unit
42 pack
46 supply of containers
47 container divider
48 film wrapping module
50 attachment- and cutting device/welding station
52 shrinking tunnel

What is claimed is:

1. A film wrapping device comprising:

a splicing device with at least three roll-off devices for one roll of sheet-like flat material each, comprising: at least three welding bars, the welding bars movable within a common plane and at least one clamp, the clamp being positioned in an approximately horizontal plane above the welding bars and movable in this approximately horizontal plane above the welding bars, one welding bar being assigned to each of the at least three roll-off devices; and a shrinking tunnel for shrinking the sheet-like flat material.

2. The film wrapping device as recited in claim 1 wherein the welding bars are movable toward each other to press a beginning of a full material roll against the flat-sheet like material of an almost depleted roll of material and to controllably weld the beginning of the full material roll to the flat sheet-like material of the almost depleted roll of material leading to a processing station, the flat sheet-like material of the almost depleted roll simultaneously being separated from the material leading to the processing station.

3. The film wrapping device as recited in claim 1 wherein the welding bars are pressable against each other for temporary and simultaneous fixation of all beginnings of the flat sheet-like material of full, yet unrolled material rolls and for the temporary and simultaneous fixation of the respective end of the almost depleted flat sheet-like material leading to the processing station to be welded to the activated new, full material roll.

4. The film wrapping device as recited in claim 1 wherein the splicing device comprises a supply of rolls of sheet-like flat material.

5. The film wrapping device as recited in claim 4 wherein the supply of rolls of sheet-like flat material comprises three or more rolls of sheet-like flat material.

6. The film wrapping device as recited in claim 1 wherein the sheet-like flat material is a plastic film.

* * * * *